US007144137B2

(12) United States Patent
Liu

(10) Patent No.: US 7,144,137 B2
(45) Date of Patent: Dec. 5, 2006

(54) LAMPSHADE

(76) Inventor: I-Wen Liu, P.O. Box 90, Tainan City (TW)

( * ) Notice: Subject to any disclaimer, the term of this patent is extended or adjusted under 35 U.S.C. 154(b) by 189 days.

(21) Appl. No.: 10/923,039

(22) Filed: Aug. 23, 2004

(65) Prior Publication Data

US 2006/0039155 A1 Feb. 23, 2006

(51) Int. Cl.
*F21V 1/06* (2006.01)
*F21S 8/04* (2006.01)

(52) U.S. Cl. ..... 362/352; 362/450

(58) Field of Classification Search ..... 362/352, 362/353, 355, 356, 357, 361, 433, 436, 440, 362/449, 450
See application file for complete search history.

(56) References Cited

U.S. PATENT DOCUMENTS 3,023,307 A * 2/1962 Okamoto ..... 362/352
3,780,287 A * 12/1973 Fauri ..... 362/352
4,075,684 A * 2/1978 Witz ..... 362/352
6,439,747 B1 * 8/2002 Liu et al. ..... 362/357

* cited by examiner

*Primary Examiner*—Y. My Quach-Lee

(57) ABSTRACT

A lampshade includes a main body made of silicone rubber and preset in shape. The main body has its upper and lower circumferential edge respectively wrapped inside with an elastic bar and the inner side of its upper circumferential edge provided with a plurality of lugs respectively bored with an insert hole. The supporting bars at the upper end of a lamp holder are respectively inserted and fixed in the insert holes at the upper inner side of the main body to prop open the upper side of the main body and let the lower side drop downward naturally to form a lampshade for use. The lampshade made of flexible silicone rubber with excellent plasticity can be collapsed to diminish its dimensions when it is not in use.

6 Claims, 9 Drawing Sheets

LAMPSHADE

BACKGROUND OF THE INVENTION

1. Field of the Invention

This invention relates to a lampshade, particularly to one having a main body made of silicone rubber and preset in shape. The main body has its upper and lower circumferential edge respectively wrapped inside with an elastic bar, able to be quickly assembled on a lamp holder or a lamp stand for use. The silicone rubber for making the lampshade could be transparent or formed with a fogged surface, colored or formed into a solid, colorful and transparent laminated body, or formed with colored drawings or branded grain. The lampshade in the present invention is made of flexible silicone rubber with excellent plasticity so it can easily be collapsed to diminish its dimensions when it is not in use. In addition, the silicone rubber for making the lampshade is able to resist high temperature (about 300° C.) and it is a fireproof and electrically insulating material, most suitable for making lampshades.

2. Description of the Prior Art

A conventional lampshade is mostly made of a hard and light-transmitting material, such as glass, plastic or acrylic plate. The conventional lampshade is threadably combined with a lamp stand or a lamp holder; therefore, it is no easy work to disassemble and assemble the lampshade, and frequent disassembling and assembling of the lampshade may cause the threaded holes of the lampshade to become larger and larger, letting bolts unable to be tightly screwed with the threaded holes and rendering components loosened to fall off. If the conventional lampshade is placed in a damp place, such as a bathroom or a basement, its threaded members are likely to be rusted and corroded.

SUMMARY OF THE INVENTION

The objective of the invention is to offer a lampshade made of silicone rubber. The silicone rubber-made lampshade could be transparent or formed with a fogged surface or colored or formed into a solid, colorful and transparent laminated body, or formed with colored drawings or branded grain. The lampshade of this invention made of soft silicone rubber is able to be collapsed to diminish its dimensions when it is not in use. The lampshade of this invention can be quickly assembled on a lamp stand, and the silicone rubber for making the lampshade is able to resist high temperature (about 300° C.) and it is a fireproof and electrically insulating material, most suitable for making lampshades.

A first feature of the invention is a main body made of silicone rubber and preset in shape. The main body has its upper and lower circumferential edge respectively wrapped inside with an elastic bar and also has the inner side of its upper circumferential edge provided with a plurality of lugs respectively bored with an insert hole.

A second feature of the invention is a main body made of silicone rubber and preset in shape. The main body has its lower circumferential edge wrapped inside with an elastic bar and its upper inner side fixed with an upper elastic bar having a plurality of lugs fixed at the inner side, with each lug bored with an insert hole.

A third feature of the invention is a main body made of silicone rubber and preset in shape. The main body has its circumferential edge wrapped inside with an elastic bar able to be quickly engaged with the elastic engage edge of a lamp stand, able to be used as a ceiling lampshade.

A fourth feature of the invention is a flat sheet-shaped main body made of silicone rubber and preset in shape. The sheet-shaped main body has its peripheral edge wrapped inside with an elastic bar and provided at proper locations with a plurality of lugs respectively bored with a fitting hole.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
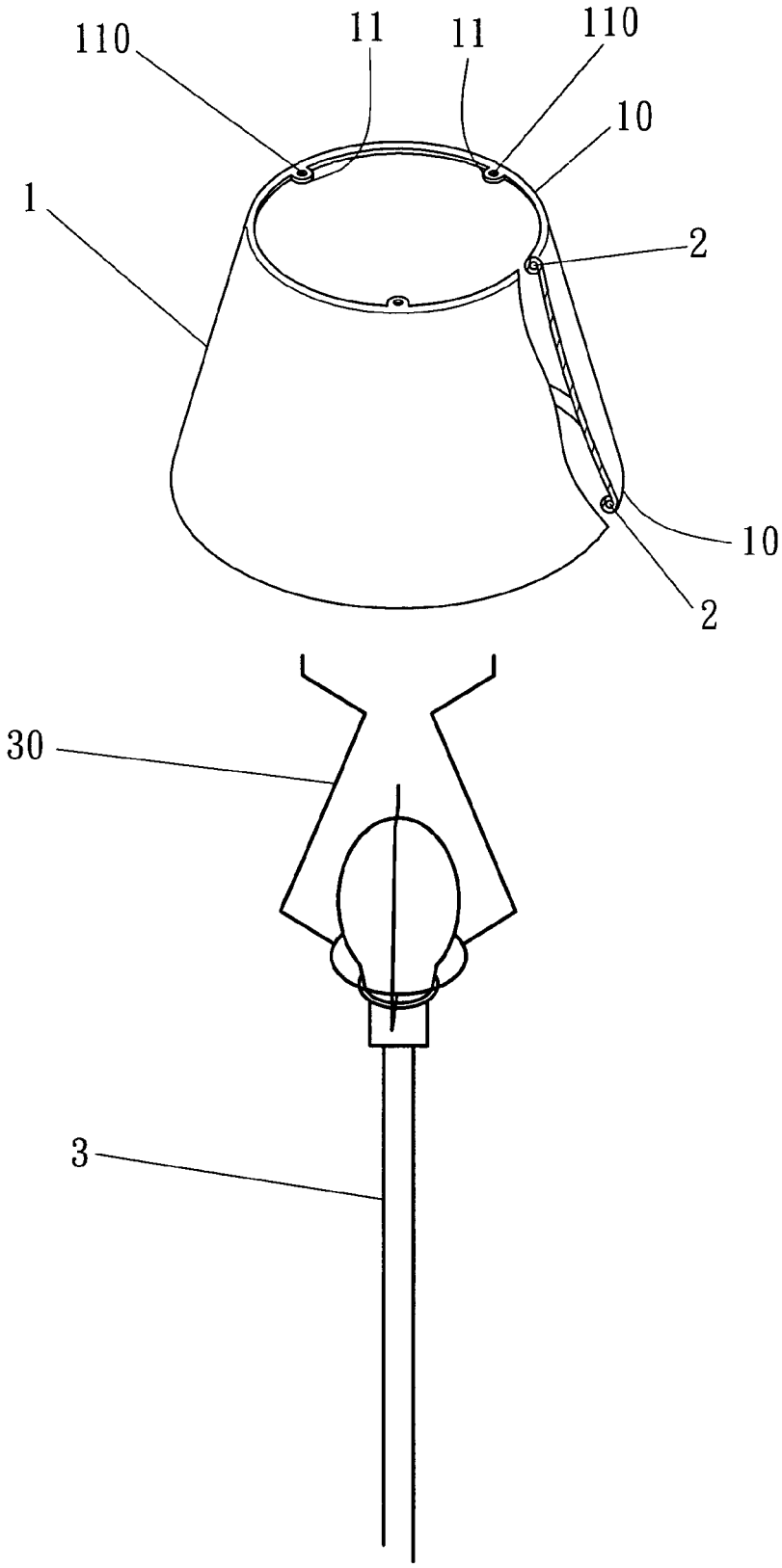
FIG. 1 is an exploded perspective view of a first preferred embodiment of a lampshade in the present invention.
Figure 2:
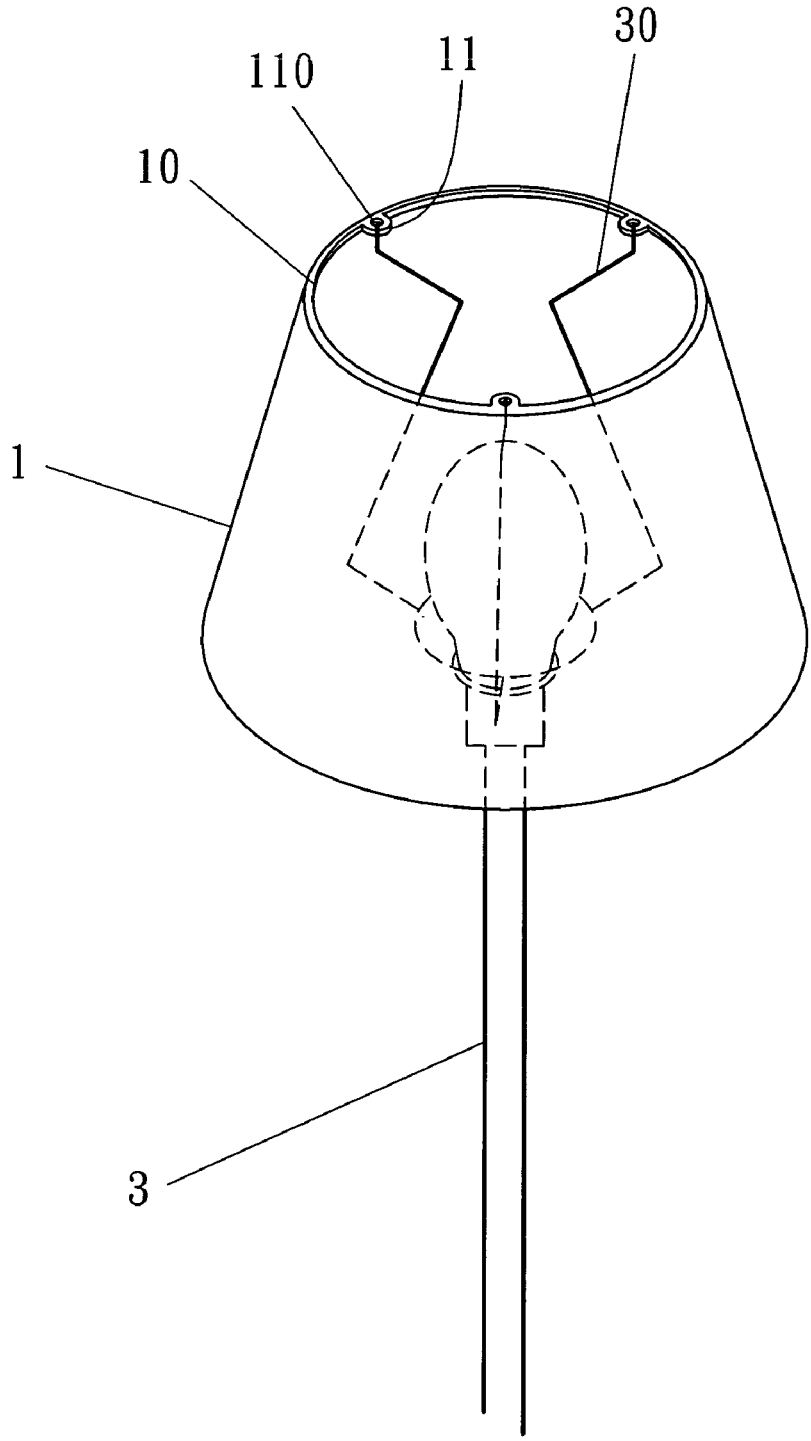
FIG. 2 is a perspective view of the first preferred embodiment of the lampshade in the present invention.

A first preferred embodiment of a lampshade in the present invention, as shown in FIGS. 1 and 2, includes a main body 1 made of silicone rubber and preset in shape, such as a cylindrical shape, a conical shape, a square or rectangular shape, an umbrella shape or other geometric shapes. The main body 1 has its upper and lower circumferential edges 10 respectively wrapped inside with an elastic bar 2 made of metal or plastic, and the inner side of its upper circumferential edge 10 provided with a plurality of lugs 11 respectively bored with an insert hole 110. Thus, when the supporting bars 30 at the upper end of a lamp holder 3 are respectively inserted and fixed in the insert holes 110 at the upper inner side of the main body 1, the supporting bars 30 of the lamp holder 3 will prop open the upper side of the main body 1 and let the lower side of the main body 1 drop downward naturally to form a lampshade for use. The silicone rubber for making the lampshade is a flexible material with excellent plasticity; therefore, the lampshade can be collapsed to diminish its dimensions when it is not in use, impossible to be broken. In addition, the silicone rubber can resist high temperature (about 300° C.) and it is a fireproof and electrically insulating material, most suitable for making lampshades.

Figure 3:
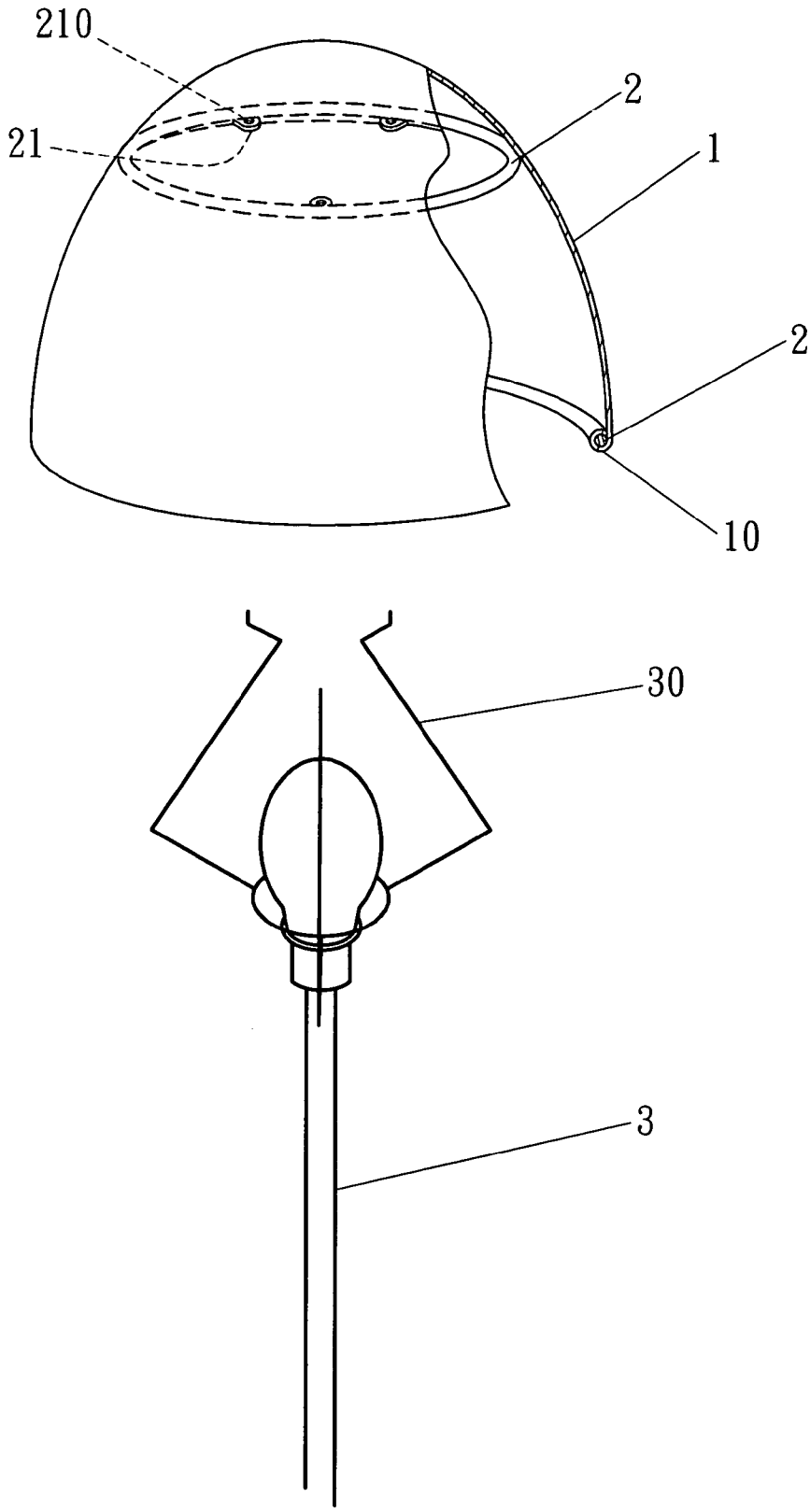
FIG. 3 is an exploded perspective view of a second preferred embodiment of a lampshade in the present invention.
Figure 4:
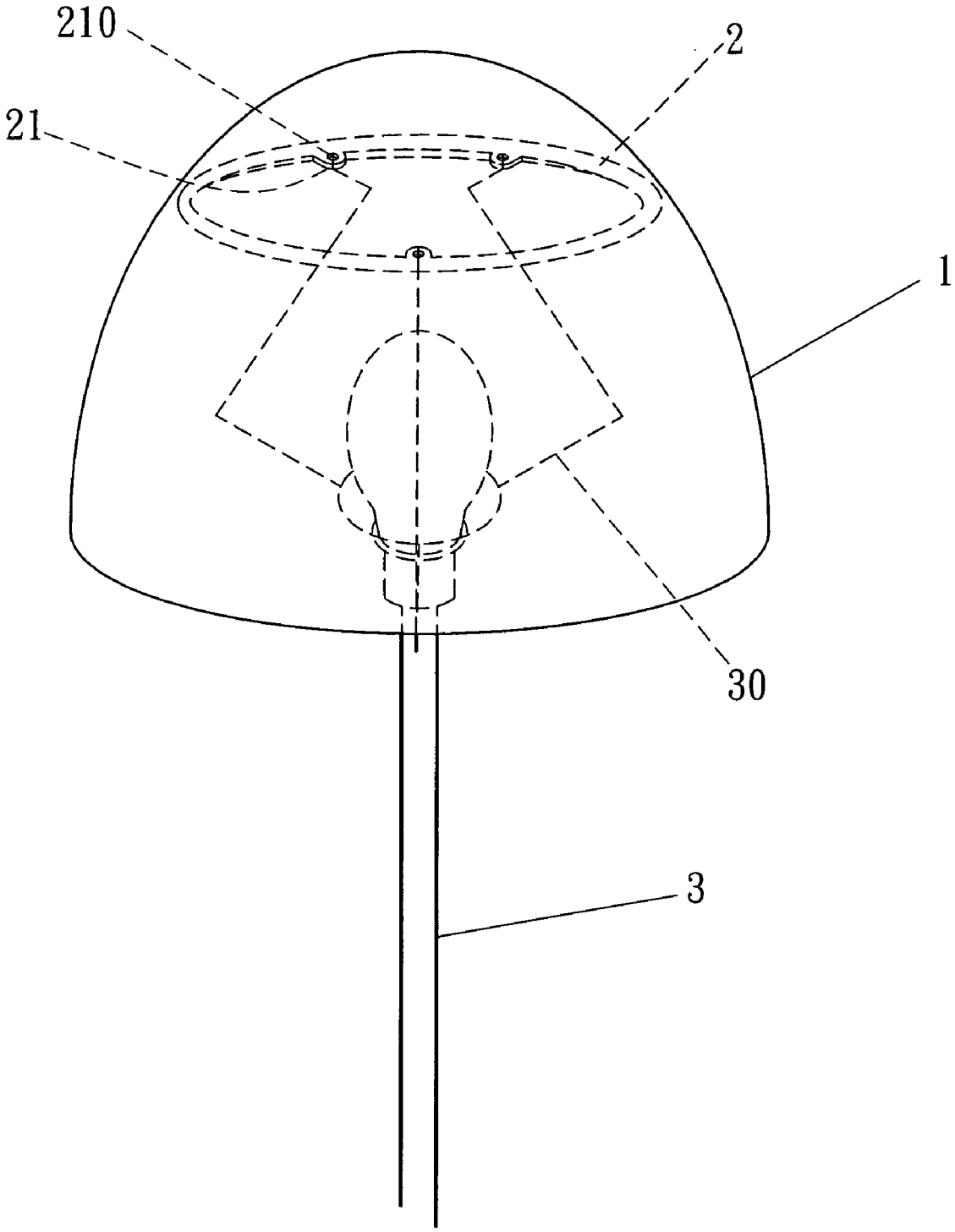
FIG. 4 is a perspective view of the second preferred embodiment of the lampshade in the present invention.

A second preferred embodiment of a lampshade in the present invention, as shown in FIGS. 3 and 4, includes a main body 1 made of silicone rubber and preset in shape, such as an approximately semi-circular shape or an umbrella shape or a mushroom shape. The main body 1 has its lower circumferential edge 10 wrapped inside with an elastic bar 2 and its upper inner surface fixed thereon with an upper elastic bar 2, which is provided on its inner side with a plurality of lugs 21 respectively bored with an insert hole 210. Thus, when the supporting bars 30 of a lamp holder 3 are respectively inserted in the insert holes 210 of the lugs 21 of the upper elastic bar 2, they will prop open the upper side of the main body 1 and let the lower side of the main body 1 drop downward naturally to form a lampshade for use.

Figure 5:
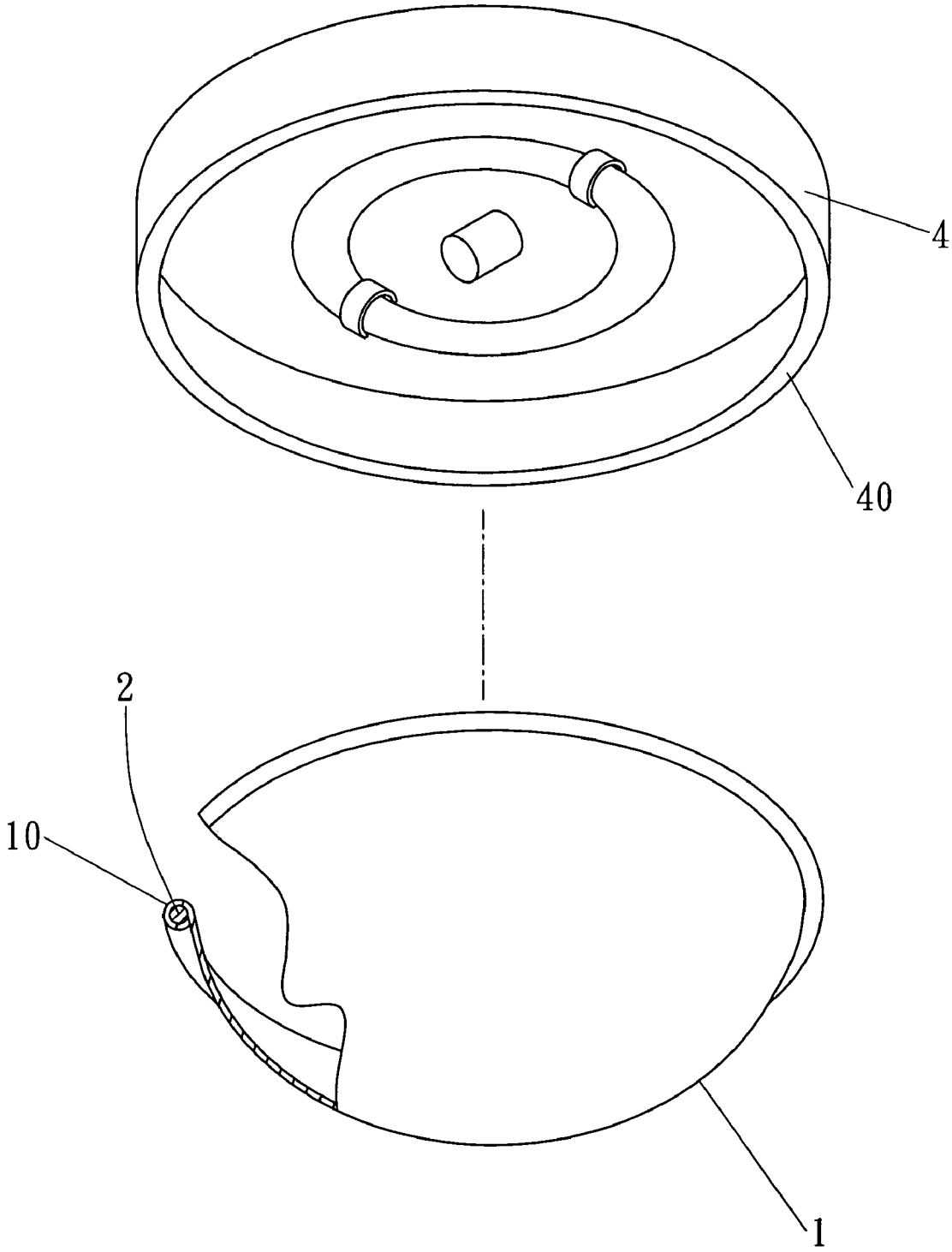
FIG. 5 is an exploded perspective view of a third preferred embodiment of a lampshade in the present invention.
Figure 6:
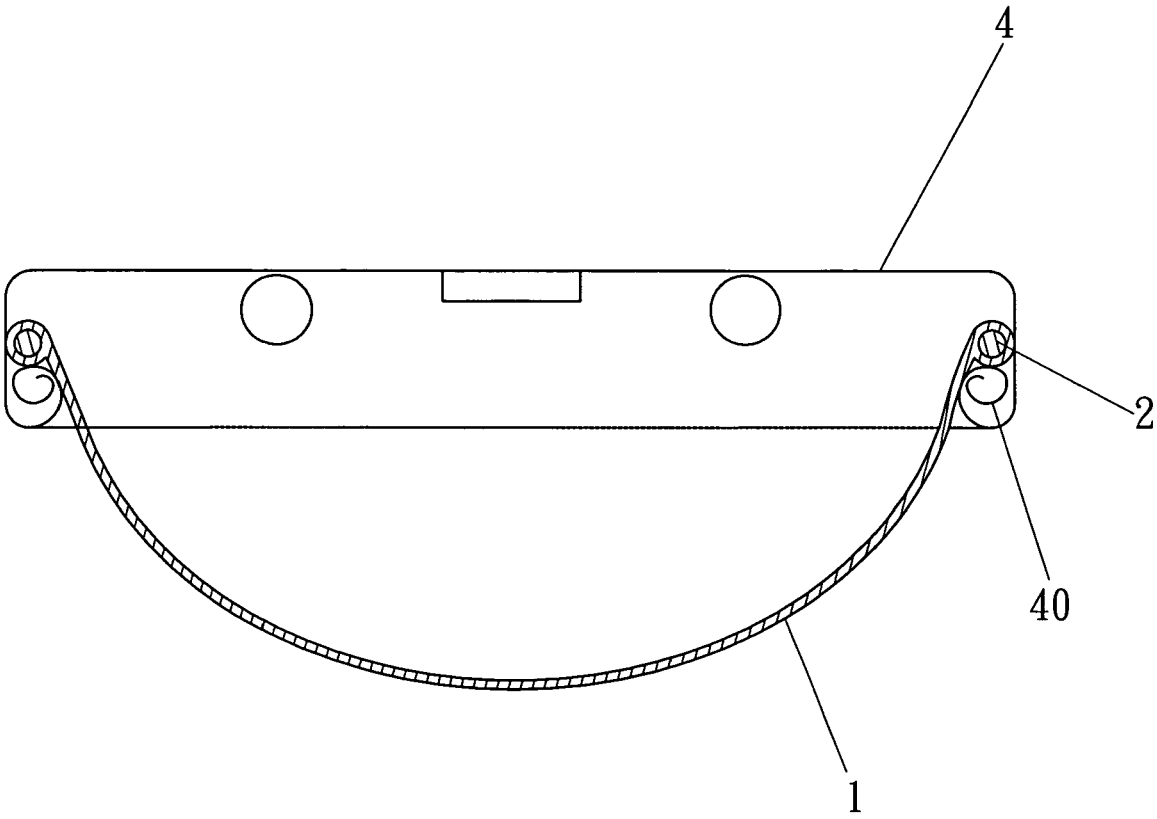
FIG. 6 is a cross-sectional view of the third preferred embodiment of the lampshade in the present invention.
Figure 7:
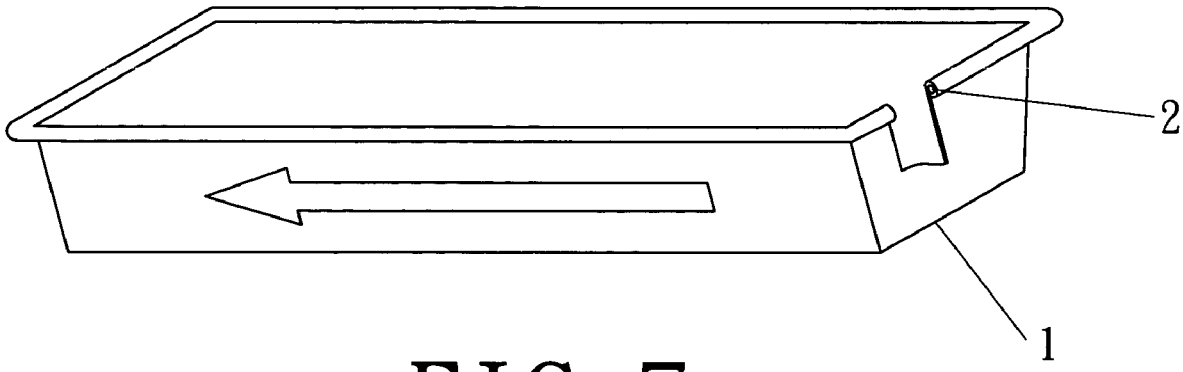
FIG. 7 is a perspective view of the third preferred embodiment of the lampshade used for an indicating lamp in the present invention.
Figure 8:
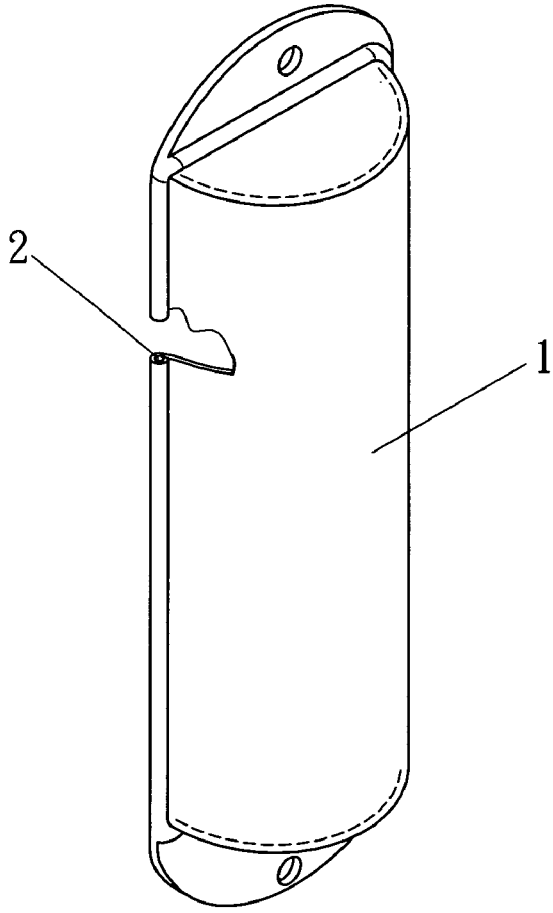
FIG. 8 is a perspective view of the third preferred embodiment of the lampshade used for a wall lamp or decorative lamp in the present invention.
Figure 9:
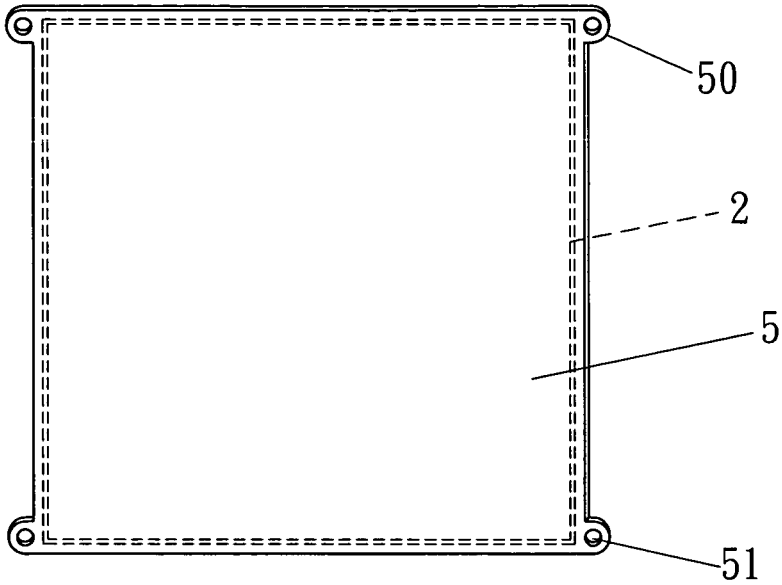
FIG. 9 is an evolved view of a fourth preferred embodiment of a lampshade in the present invention.
Figure 10:
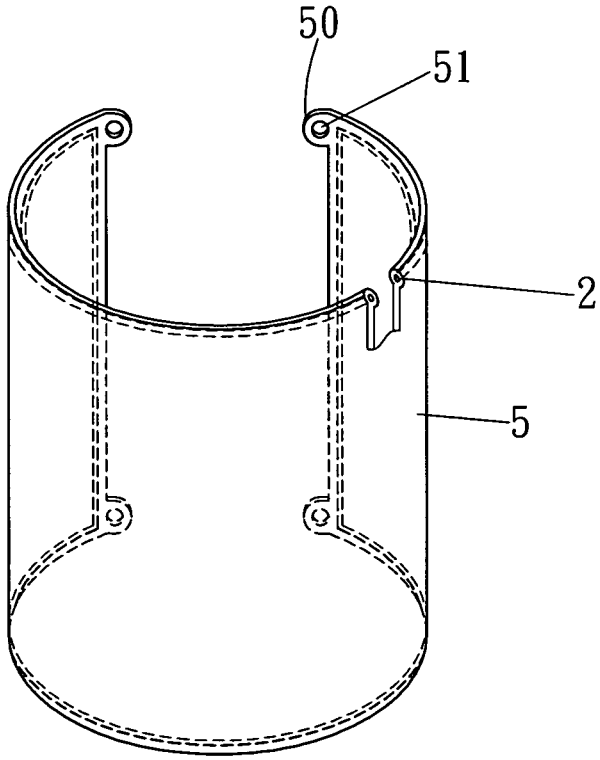
FIG. 10 is a perspective view of the fourth preferred embodiment of the lampshade in a using condition in the present invention.
Figure 11:
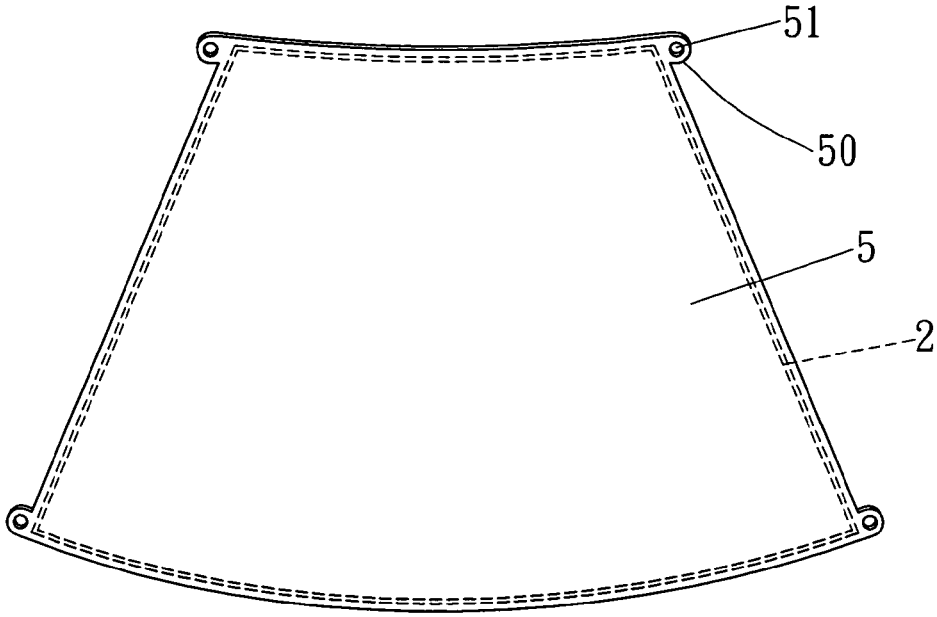
FIG. 11 is an evolved view of the fourth preferred embodiment of another lampshade in the present invention; and, FIG. 12 is a perspective view of the fourth preferred embodiment of another lampshade in a using condition in the present invention.
Figure 12:
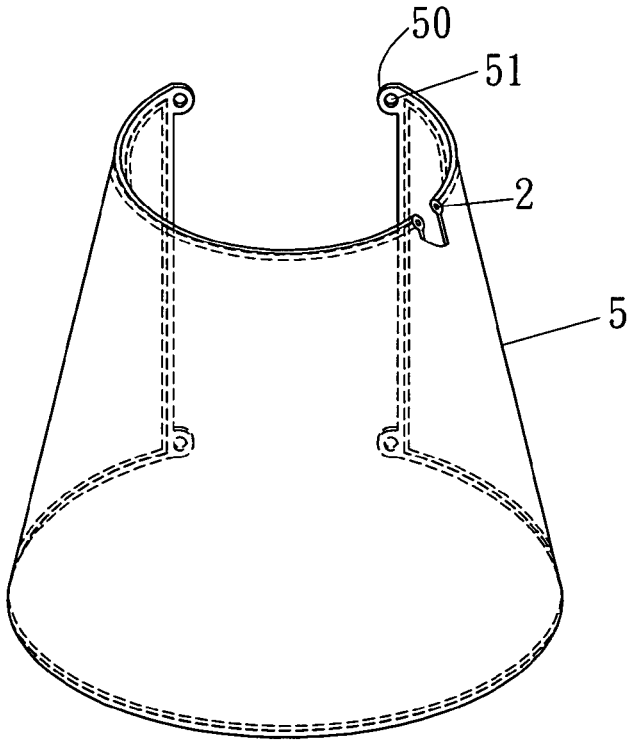

A third preferred embodiment of a lampshade in the present invention, as shown in FIGS. 5 to 8, includes a main body 1 made of silicone rubber to be used for a ceiling lamp. The main body 1 has its peripheral edge 10 wrapped inside with an elastic bar 2. Thus, when the lampshade of this invention is used for a ceiling lamp, as shown in FIGS. 5 and 6, or used for a decorative lamp or an indicating lamp, as shown in FIG. 7, or used for a wall lamp, as shown in FIG. 8. When it is assembled with a lamp stand 4, the elastic bar 2 of the main body 1 can be quickly engaged and combined with the elastic engage edge 40 of the lamp stand 4, as shown in FIG. 6.

A fourth preferred embodiment of a lampshade in the present invention, as shown in FIGS. 9 to 12, includes a flat sheet-shaped main body 5 made of silicone rubber and preset in shape, such as a square or rectangular shape, a trapezoid shape, a fan shape or other geometric shapes. The main body 5 has its upper and lower peripheral edge wrapped inside with an elastic bar 2 and is provided at proper locations with plural lugs 50 respectively bored with a fitting hole 51. In assembling, a wall lamp is first installed at a proper location of a wall surface by means of fixing members, such as nails, screws or the like. Next, the sheet-shaped main body 5 is rolling up into a preset shape, and then the fitting holes 51 of the lugs 50 of the main body 5 are respectively fitted on the fixing members of the wall lamp by the elastically expanding force of the silicone rubber, with the heads of the fitting members respectively stopping the fitting holes 51 from slipping off.

As can be understood from the above description, this invention has the following advantages.

1. The lampshade is made of silicone rubber that is able to resist high temperature (about 300° C.), and that is a fireproof and insulating material, most suitable for making lampshades.

2. The lampshade made of the silicone rubber could be transparent or formed with a fogged surface or colored or formed into a solid, colorful and transparent laminated body, or formed with colored drawings or branded grain, having an elegant appearance and practical in use.

3. The lampshade has its circumferential edge wrapped inside with an elastic bar made of metal or plastic, enabling the lampshade to be assembled on a lamp stand conveniently and quickly.

While the preferred embodiments of the invention have been described above, it will be recognized and understood that various modifications may be made therein and the appended claims are intended to cover all such modifications that may fall within the spirit and scope of the invention.

What is claimed is:

1. A lampshade comprising a main body preset in shape, said main body having its lower circumferential edge wrapped inside with an elastic bar, said main body further having its upper inner side fixed with an upper elastic bar, said upper elastic bar provided with a plurality of lugs on the inner side, each said lug bored with an insert hole; and, a plurality of supporting bars at an upper end of a lamp holder respectively inserted in said insert holes of said upper elastic bar of said main body, said supporting bars of said lamp holder supporting said main body to be a lampshade.

2. The lampshade as claimed in claim 1, wherein said elastic bar is made of metal.

3. The lampshade as claimed in claim 1, wherein said elastic bar is made of plastic.

4. A lampshade comprising a flat sheet-shaped silicone rubber main body preset in shape, said main body having its upper and lower peripheral edge wrapped inside with an elastic bar, said main body provided with a plurality of lugs at proper locations of said upper and said lower peripheral edge, each said lug bored with a fitting hole; and, said main body, after rolled up, having said fitting holes of said lugs respectively fitted on fixing members of a wall lamp by the elastic expanding force of said silicone rubber of said main body, the heads of said fixing members of said wall lamp stopping said fitting holes from slipping off.

5. The lampshade as claimed in claim 4, wherein said elastic bar is made of metal.

6. The lampshade as claimed in claim 4, wherein said elastic bar is made of plastic.

* * * * *